US008167151B2

(12) United States Patent
Golias, Jr. et al.

(10) Patent No.: US 8,167,151 B2
(45) Date of Patent: May 1, 2012

(54) FORKABLE BASE STAND

(75) Inventors: Bernard J. Golias, Jr., Twinsburg, OH (US); Gary W. James, Parma Heights, OH (US); Gary R. Kish, Parma, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 328 days.

(21) Appl. No.: 12/490,994

(22) Filed: Jun. 24, 2009

(65) Prior Publication Data

US 2010/0044329 A1 Feb. 25, 2010

Related U.S. Application Data

(60) Provisional application No. 61/075,164, filed on Jun. 24, 2008.

(51) Int. Cl.
*A47B 43/00* (2006.01)

(52) U.S. Cl. ..... 211/186

(58) Field of Classification Search ..... 211/186, 211/135, 41.14, 191, 195, 189; 108/55.3, 108/55.1, 53.1; 410/143, 144
See application file for complete search history.

(56) References Cited

U.S. PATENT DOCUMENTS 3,590,752 A * 7/1971 De Pew ..... 108/55.3
4,260,072 A * 4/1981 Quasarano ..... 221/92
4,467,922 A * 8/1984 Rowley ..... 206/597
4,934,538 A * 6/1990 Beyer ..... 211/49.1
5,141,114 A * 8/1992 Cate et al. ..... 211/85.8
5,176,265 A * 1/1993 Bennett ..... 211/85.18
5,326,204 A * 7/1994 Carlson et al. ..... 410/143
5,533,456 A * 7/1996 Regina ..... 108/57.29
6,032,912 A * 3/2000 Korn et al. ..... 248/346.01
6,135,294 A * 10/2000 Shuert ..... 211/13.1
6,220,462 B1 * 4/2001 Brockman et al. ..... 211/131.1
6,273,006 B1 * 8/2001 Reutter et al. ..... 108/53.1
6,298,999 B1 * 10/2001 Bellman ..... 211/24
6,422,405 B1 * 7/2002 Haenszel ..... 211/175
6,585,224 B1 * 7/2003 Schmidt ..... 248/640
7,021,461 B1 * 4/2006 Robey ..... 206/335
7,726,496 B2 * 6/2010 Heinrichs et al. ..... 211/191
2002/0088766 A1 * 7/2002 Flores ..... 211/194
2004/0140275 A1 * 7/2004 Jeskey et al. ..... 211/41.14
2005/0000924 A1 * 1/2005 Webb ..... 211/59.2
2005/0000929 A1 * 1/2005 Dunn ..... 211/194
2005/0284831 A1 * 12/2005 Snyker et al. ..... 211/133.4
2006/0108307 A1 * 5/2006 Kin ..... 211/189
2006/0213807 A1 * 9/2006 Sonon ..... 206/736
2007/0215568 A1 * 9/2007 Heinrichs et al. ..... 211/191
2008/0217276 A1 * 9/2008 Brady et al. ..... 211/195
2009/0078660 A1 * 3/2009 Kin ..... 211/60.1
2009/0078665 A1 * 3/2009 Sandusky et al. ..... 211/208
2009/0218304 A1 * 9/2009 Manara ..... 211/195
2009/0250416 A1 * 10/2009 Chookang ..... 211/41.14
2009/0272705 A1 * 11/2009 Francis ..... 211/126.12
2010/0044329 A1 * 2/2010 Golias et al. ..... 211/135
2010/0065518 A1 * 3/2010 Noda et al. ..... 211/41.14
2011/0017686 A1 * 1/2011 Burra et al. ..... 211/71.01

* cited by examiner

*Primary Examiner* — Sarah Purol
(74) *Attorney, Agent, or Firm* — Fay Sharpe LLP; James E. Scarbrough

(57) ABSTRACT

A base stand for transporting a metal storage bin having a main body with a top wall, first side wall, a second side wall, a third side wall and a fourth side wall; a first bracket mounted to the first side wall; a second bracket mounted to the second side wall; wherein the third side wall has a first opening and a second opening for receiving associated forks of an associated forklift. A metal storage bin is supported on the top wall of the base stand, and the first and second brackets extend along side walls of the metal bin to provide lateral support to the bin.

21 Claims, 4 Drawing Sheets

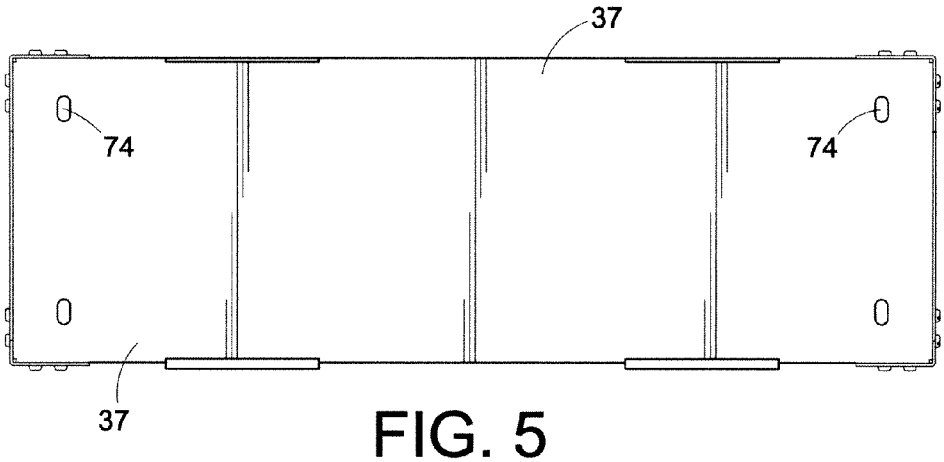
FIG. 5
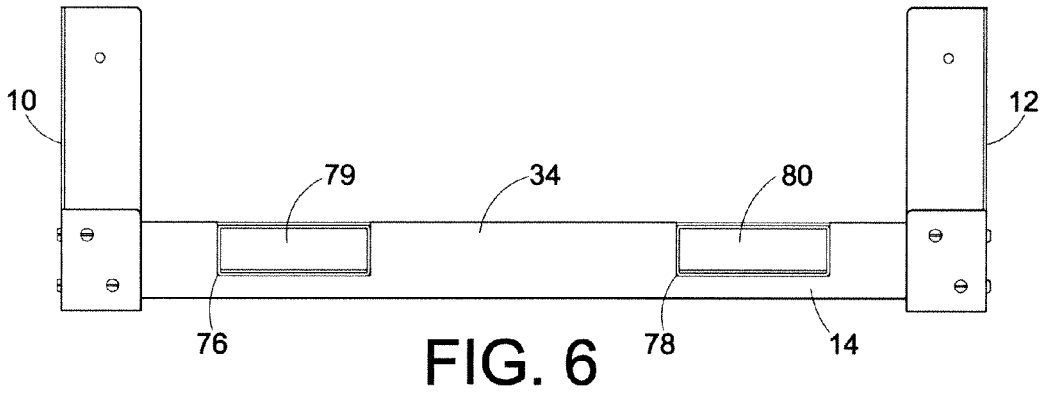
FIG. 6
FIG. 7
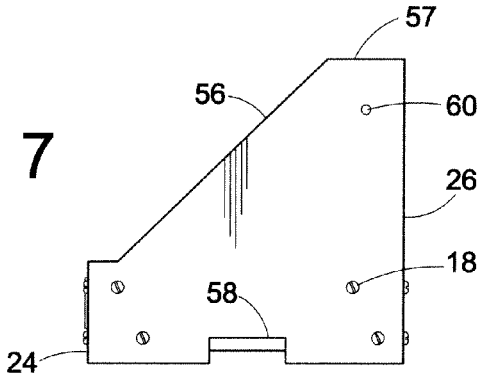

FORKABLE BASE STAND

CLAIM OF PRIORITY

This application claims priority from Provisional Patent Application No. 61/075,164 filed on Jun. 24, 2008, which is hereby incorporated by reference.

BACKGROUND OF THE DISCLOSURE

The present disclosure relates generally to units for storage. More particularly, the disclosure relates to a "forkable" or movable base stand used to move and transport metal compartment bins.

Metal compartment bins and cabinets are some of the most versatile pieces of furniture available. The cabinets can be hung in work areas such as metal or woodworking shops, garages, as well as many other places. Cabinets and compartment bins can also provide storage in vehicles such as trucks and vans. Metal cabinets also provide versatility in what they store. For example, metal cabinets and compartment bins have been used to store threaded rod, wire, brake line, welding rods, as well as more common items such as tools and fasteners.

A common way of lifting and transporting such cabinets is by sliding the forks of a typical forklift directly under the bottom wall of the cabinet. A problem with this lifting approach is that the cabinet is not secured and can become unstable when it is being lifted. Also, stacking of one cabinet on top of another becomes very difficult and impractical without providing some support for the bottom of the metal cabinet.

Accordingly, it is desired to provide a base stand for supporting, lifting and transporting metal cabinets or storage bins which overcomes the above-mentioned difficulties and others while providing improved overall results.

SUMMARY OF THE DISCLOSURE

According to one aspect of the disclosure, the forkable base stand includes a main body and a pair of legs or end brackets attached to opposite sides of the body. A metal cabinet or bin is placed on top of the base stand. Each leg extends from the base stand about halfway up the bin side wall to provide rigidity and support to the bin. Also, the legs help prevent swaying of the bin from side to side on the base stand. Each leg of the base stand has a notch formed in a bottom edge which compensates for irregularities on the floor. At an upper edge of each leg, two holes are drilled to secure the legs directly to the metal bins. Corresponding holes are drilled through the bin walls so that removable fasteners can be inserted through the holes of the legs and the bin to secure the legs to the bin. Each leg forms a lip or wall extending from one of the side walls of the leg to provide additional lateral support to the metal bin.

The base stand itself includes an upper wall and four side walls extending downwardly therefrom. A bottom wall may also be provided as part of the base stand. The base stand can be formed of one sheet wherein the side walls are bent downwardly from the top wall. Four holes are formed on opposite side walls of the stand to attach the legs to the stand via fasteners.

Two rectangular openings are formed in a front wall of the stand. The openings receive the forks of the conventional forklift and are spaced apart to correspond to the spacing of the forks of the forklift. The openings are shown as rectangular, but could also be square or other configurations without departing from the scope of the present disclosure.

Rectangular shaped inserts are provided to be inserted or slid into the rectangular openings. The inserts are shaped as rectangular boxes with a top wall and two connecting side walls. A separate bottom wall is provided as well. A rear end wall may also be provided. The walls can be formed from one sheet or can be several sheets welded or fastened together. The inserts provide additional rigidity and support for the forks of the forklifts. The inserts can be welded, press fit or riveted within the rectangular openings. One of the ends of the insert may protrude out of the opening of the base stand to act as a guide for aligning and inserting a fork into the opening.

An additional insert may be provided to be inserted into the rectangular openings. The insert has a front wall, with a rectangular cutout or opening therein. Two legs or arms extend from opposed, inner edges of the opening of the insert. The insert is then inserted into the rectangular slot or the rectangular box and then riveted or press-fit into the slot or opening of the box.

In accordance with one aspect of the disclosure, a base stand for transporting a metal storage bin includes a main body including a top wall, first side wall, a second side wall, a third side wall and a fourth side wall; a first bracket mounted to the first side wall; a second bracket mounted to the second side wall; wherein the third side wall has a first opening and a second opening for receiving associated forks of an associated forklift.

In accordance with another aspect of the invention, a base stand and metal storage bin assembly includes a metal storage bin having a top wall, a bottom wall and first and second side walls; a base stand for transporting a metal storage bin having a main body having a top wall, first side wall, a second side wall, a third side wall and a fourth side wall; a first bracket mounted to the first side wall; a second bracket mounted to the second side wall; wherein the third side wall comprises a first opening and a second opening for receiving associated forks of an associated forklift; and wherein the metal bin is positioned on an upper surface of the base stand such that the first and second brackets extend along a portion of the first and second side walls for providing lateral support to the first and second side walls.

Still another aspect of the disclosure is a base stand which has legs or end brackets for providing lateral support to a metal bin or cabinet while being moved or transported.

Another aspect of the disclosure is a base stand having a lip formed by a leg for providing additional lateral support to the metal bin or cabinet.

Another aspect of the disclosure is inserts inserted into openings in the stand for receiving forks of a forklift to provide additional support while lifting the stand and the cabinet.

Still other aspects of the present disclosure will become apparent upon a reading of the following detailed description.

BRIEF DESCRIPTION OF THE DRAWINGS

The disclosure takes form in certain parts and arrangements of parts, preferred embodiments of which will be described in detail in this specification and illustrated in the accompanying drawings which form a part hereof and wherein:

FIG. 5 is a top plan view of the base stand of FIG. 1;

FIG. 6 is a front view of the base stand of FIG. 5;

FIG. 7 is a side elevational view of a leg of the base stand of FIG. 6.

DETAILED DESCRIPTION OF THE DISCLOSURE

Referring now to the Figures, the showings are for purposes of illustrating the preferred embodiments of the disclosure only and are not for purposes of limiting same. Directional terms such as "left," "right," "front," "rear," "top," and "bottom" and the like will be used to simplify the description of the Figures only and should not be construed as limiting the components to those directional terms.

The disclosure has been described with reference to a preferred embodiment. Obviously, modifications and alterations will occur to others upon the reading and understanding of this specification. It is intended to include all such modifications and alterations.

The present disclosure relates to a base stand for supporting and transporting metal storage containers. More particularly, referring to FIG. 1, it relates to a "forkable" or movable base stand A for lifting or transporting a metal bin or container B via forks on a conventional forklift (not shown). The bin includes opposed side walls 100, 104, a top wall 102, a bottom wall 106 and at least one shelf 108 within the bin. A bin of up to 200 pounds or more in weight can be supported on the base stand. The base stand also allows metal containers or cabinets to be stacked one on top of another during movement. That is, a second base stand with a second bin attached thereto can be stacked directly on top of a first bin and first base stand assembly.

Figure 2:
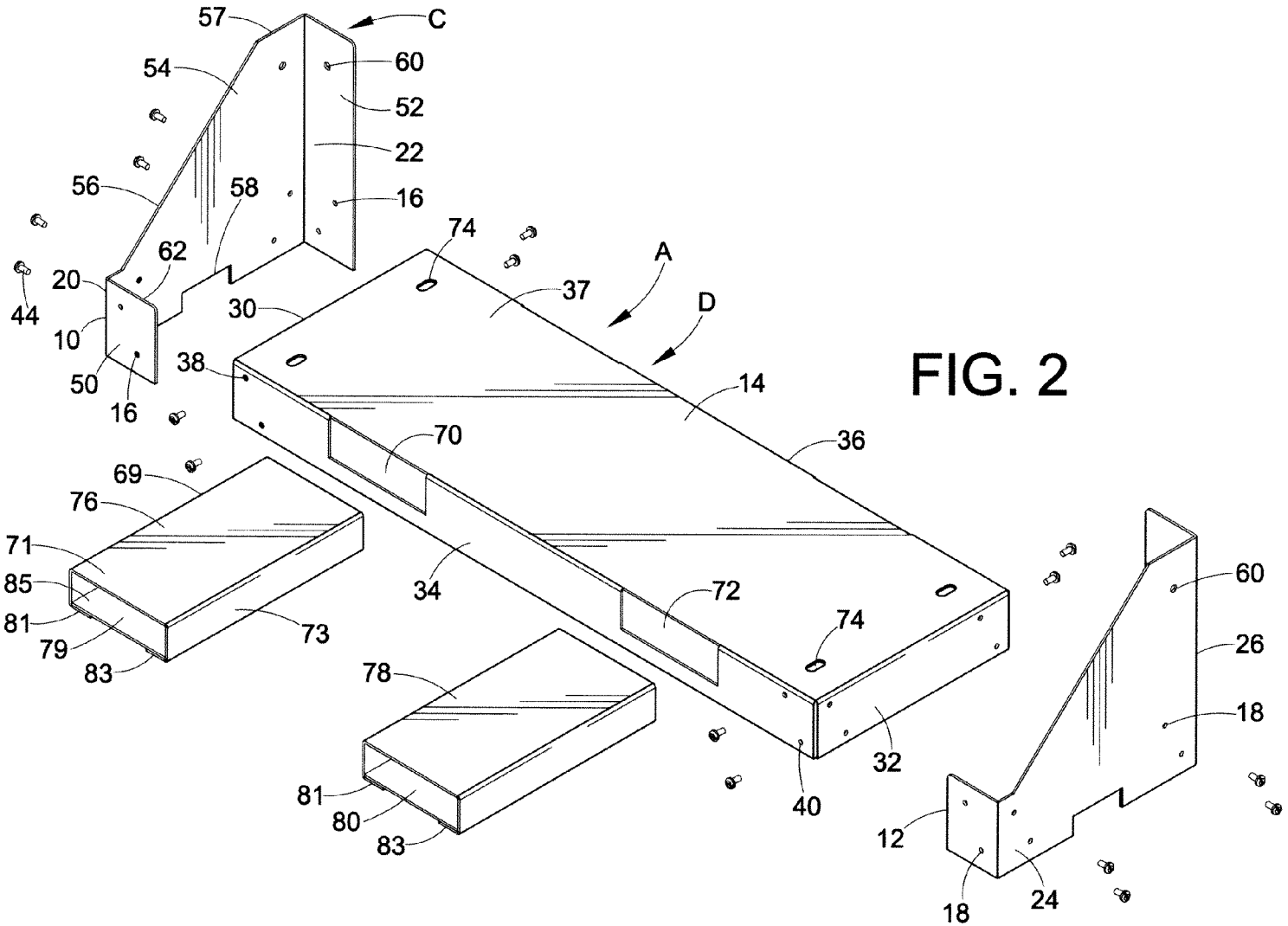
FIG. 2 is an exploded perspective view of the base stand of FIG. 1.

Referring now to FIG. 2, the forkable base stand A in accordance with a preferred embodiment of the present disclosure is shown. The base stand A includes two one-piece angled legs or end brackets C which act as gussets and are mounted on opposite sides of the base stand main body D. Two pairs or four holes 16, 18 are provided on each end 20, 22, 24, 26 of each leg 10, 12 to secure the leg to corresponding side walls 30, 32, 34, 36 of the base stand main body D. The legs provide additional rigidity and help reinforce lateral support of the metal cabinet or bin.

The stand side walls have corresponding pairs of holes 38, 40 which are aligned with the holes 16, 18 on the legs. Each leg is secured to the stand by fasteners 44, such as screws or bolts or nuts which are inserted through the holes of the legs and the base stand. The fasteners may be welded or otherwise secured into place.

Referring to FIG. 2 and FIG. 7, each leg C has a first side or front wall 50, a second rear or side wall 52, and a main or third wall 54 extending between the side walls. The leg is shown as fabricated of one piece of metal but can be fabricated from several pieces of metal welded together or otherwise fastened together. Wall 54 has an angled upper edge 56 and a top flat edge 57 formed at an intersection with the angled edge 56. The angle can be about 45 degrees, more or less. The angled edge 56 can be curved as well. Side walls 50, 52 are formed and bent at a substantially 90-degree angle with respect to wall 54 and are substantially parallel to each other and perpendicular to wall 54. Wall 52 is longer than wall 50. A notch 58 is formed in a lower or bottom portion of wall 54 to account for and compensate for variations in floor or work surfaces on which the base stand is placed. The notch can be rectangular in shape, but other shapes can be used as well, such as square, oval, elliptical, etc.

Two additional holes 60 are formed on upper ends of adjacent walls 52 and 54 to facilitate securing the base stand to a metal cabinet or bin. Corresponding holes are similarly formed in walls of the bin to insert fasteners through the walls of the bin and legs.

Figure 1:
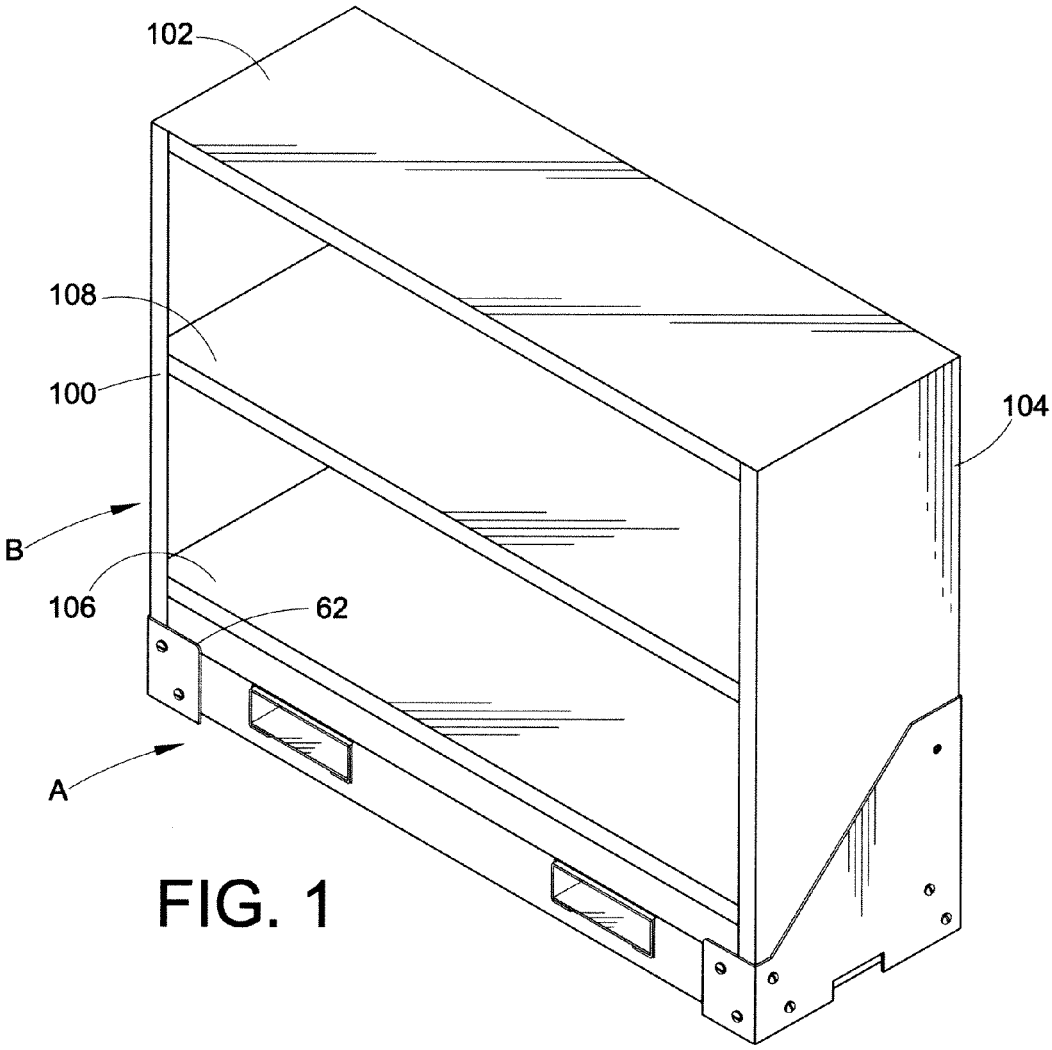
FIG. 1 is a perspective view of a base stand with a metal container installed thereon according to the present disclosure.
Figure 3:
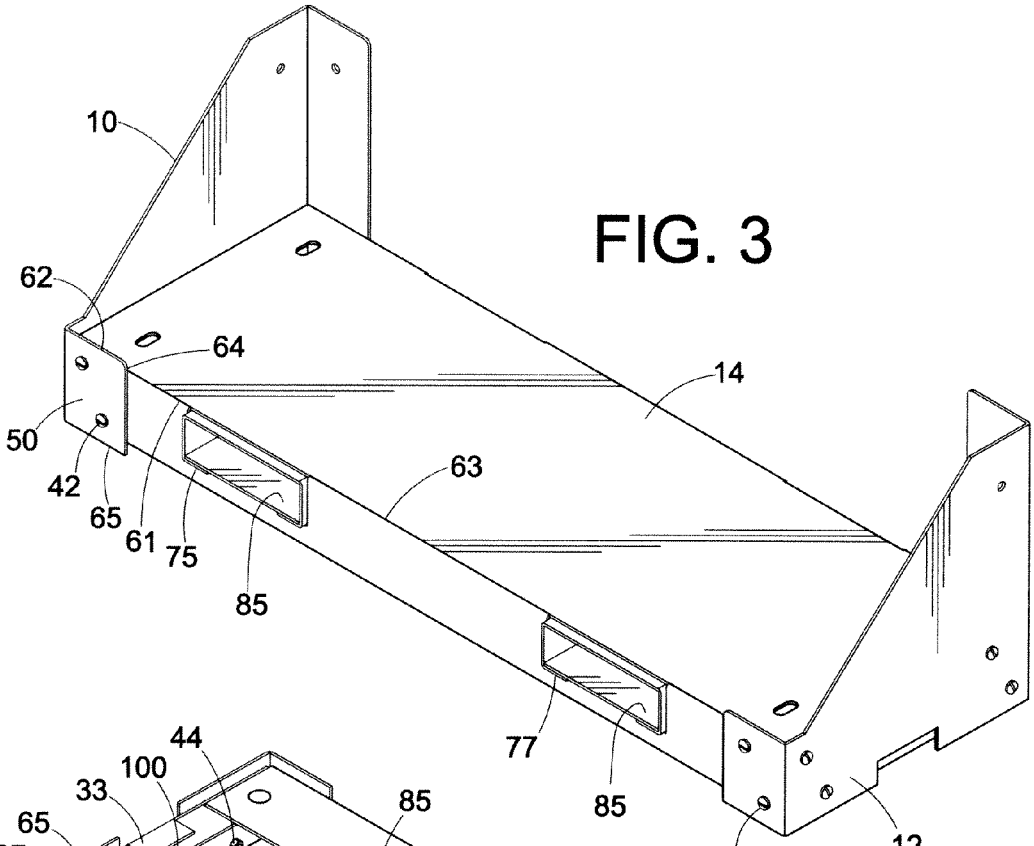
FIG. 3 is a top perspective view of the base stand of FIG. 1.

As seen in FIG. 1 and FIG. 3, when installed, an upper edge 62 of wall 50 extends above a top edge 63 of the base stand to form a raised lip 64 to provide additional lateral support for the bottom of walls 100, 104 of the metal bin. Also, referring to FIG. 4, another lip 65 can be formed by lower portion 66 of the legs below the bottom surface 67 of the base stand main body to form a lateral support for an upper portion of a metal bin positioned underneath the base stand. Conversely, the lower portion 66 of the legs can be shortened so as not to overlap with another bin directly below the legs.

Figure 4:
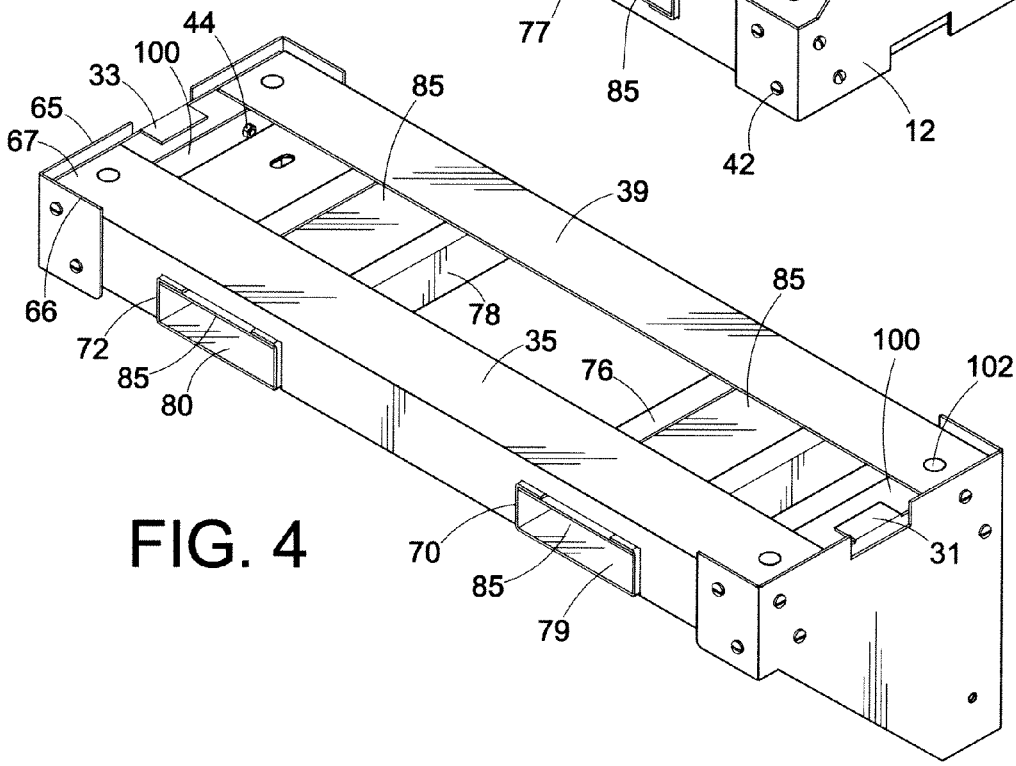
FIG. 4 is a bottom perspective view of the base stand of FIG. 3.

The base stand D may be formed of a single sheet of metal which is bent into the configuration shown in FIG. 2 and FIG. 4, or it may be formed of separate pieces of metal which are secured or welded together. Similarly, the legs C can be formed of a single sheet of metal, but also can be fabricated from several pieces welded or otherwise secured together.

Referring now to FIGS. 2 and 4, the base stand D has a rectangular shaped main body 14 formed by a plurality of side walls 30, 32, 34, 36 extending from upper wall 37. Opposed walls 30, 32 are substantially parallel to each other and opposed walls 34, 36 are substantially parallel to each other. Walls 30, 32, 34, 36 have portions 31, 33, 35, 39, which are bent inwardly toward a center of the stand to form a bottom support edge or surface from the base stand. Braces 100 with holes 102 therein may be secured between opposed walls 35, 39 to provide further rigidity and reinforcement.

Referring to FIG. 2, four holes 38, 40 are formed on each corner of the base stand which correspond to holes 16, 18 in the legs to mount the legs to the base stand via fasteners 44. Other numbers of holes are also contemplated by the disclosure.

Referring now to FIG. 5, four elongated slots or holes 74 are formed on upper surface of wall 37 for receiving fasteners for securing a lower portion of the bin to the upper surface of the wall 37. The fasteners are inserted through holes in a bottom wall of the bin and through slots 74. The holes 74 are elongated to compensate for variance in tolerances in positioning and aligning of the holes.

Referring to FIG. 2, two rectangular shaped spaced apart openings or slots 70, 72 are formed in front wall 34 of the stand for receiving a pair of spaced apart forks from a conventional forklift (not shown). Rectangular shaped inserts or boxes 76, 78 are provided to be inserted or slid into the rectangular openings or slots 70, 72 as shown in FIGS. 3 and 4. The inserts are shaped as rectangular boxes with a top wall and two connecting side walls. A separate bottom wall is provided as well. A rear end wall may also be provided. The walls can be formed from one sheet or can be several sheets welded or fastened together. The inserts provide additional rigidity and support for the forks of the forklifts. The inserts can be welded, press fit or riveted within the rectangular openings. One of the ends of the insert may protrude out of the opening of the base stand to act as a guide for aligning and inserting a fork into the opening.

Referring now to FIG. 2, each box has a top wall 71 and two side walls 69, 73 extending downwardly therefrom. Each side wall also has a lip or edge 81, 83 extending inwardly toward a center of the box from side walls 73. A flat bottom wall portion 85 can be welded or fastened to the lips 81, 83. The boxes can be welded or otherwise secured into slots 70, 72. The boxes can also project slightly out of the slots (see FIG. 3 and FIG. 4) so that about one-fourth inch or more of the box extends out of the slots 70, 72. This extension or protrusion 75, 77 can serve as an alignment guide or edge for aiding locating and inserting the forks of the forklift into openings 79, 80 formed by the walls of the boxes 76, 78.

Figure 8:
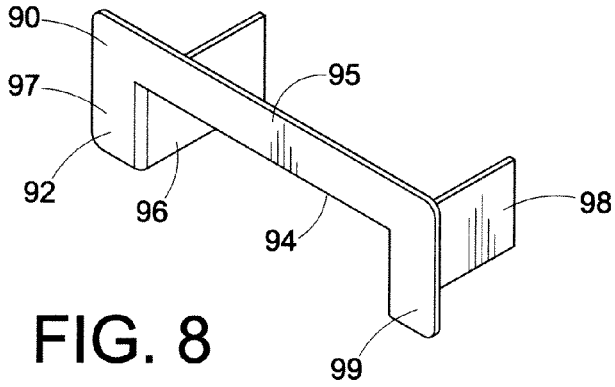
FIG. 8 is a perspective view of an insert which is installed in the opening of the base stand of FIG. 1.

Referring now to FIG. 8, an additional insert 90 can be inserted into the slots 70, 72 of the base stand or into openings 79, 80 of the boxes 76, 78 to provide additional rigidity and support for receiving the forks of the forklifts. The insert 90 has a substantially U-shaped front wall 92 with a rectangular opening 94 formed therein by portions 95, 97, 99 to receive a fork of a forklift. Two arms or walls 96, 98 are bent inwardly into opening 94 to act as guides for inserting the insert into one of the openings 79, 80 of boxes 76, 78 or into openings 70, 72 of the base stand. The insert is then riveted or press fit into place within one of the openings.

The exemplary embodiments have been described with reference to the preferred embodiments. Obviously, modifications and alterations will occur to others upon reading and understanding the preceding detailed description. It is intended that the exemplary embodiment be construed as including all such modifications and alterations.

The invention claimed is:

1. A base stand for transporting a metal storage bin comprising:

a main body comprising a top wall, first side wall, a second side wall, a third side wall and a fourth side wall;

a first bracket mounted to said first side wall which extends above said top wall of said main body and below a bottom surface of said main body and forms a first leg of said base;

a second bracket mounted to said second side wall which extends above said top wall of said main body and below said bottom surface of said main body and forms a second leg of said base;

wherein said third side wall comprises a first opening and a second opening for receiving associated forks of an associated forklift.

2. The base stand of claim 1, wherein said first bracket comprises a first wall, a second wall, and a third wall extending between said first wall and said second wall, wherein said first bracket first wall and said first bracket second wall are substantially parallel to each other and are substantially perpendicular to said first bracket third wall.

3. The base stand of claim 1, wherein said second bracket comprises a first wall, a second wall, and a third wall extending between said first wall and said second wall, wherein said second bracket first wall and said second bracket second wall are substantially parallel to each other and are substantially perpendicular to said second bracket third wall.

4. The base stand of claim 2, wherein said first bracket third wall comprises an angled portion which extends above an upper surface of said base stand main body when mounted to said body.

5. The base stand of claim 3, wherein said second bracket third wall comprises an angled portion which extends above an upper surface of said base stand main body when mounted to said body.

6. The base stand of claim 1, wherein said first bracket comprises a slot formed along a bottom end of said first bracket.

7. The base stand of claim 1, wherein said second bracket comprises a slot formed along a bottom end of said second bracket.

8. The base stand of claim 2, wherein said first bracket first wall extends above said top wall of said main body when said first bracket is mounted to said main body.

9. The base stand of claim 2, wherein said second bracket first wall extends above said top wall of said main body when said second bracket is mounted to said main body.

10. The base stand of claim 2, wherein said first bracket is formed of one piece.

11. The base stand of claim 3, wherein said second bracket is formed of one piece.

12. The base stand of claim 2, wherein said first bracket second wall is longer than said first bracket first wall.

13. The base stand of claim 3, wherein said second bracket second wall is longer than said second bracket first wall.

14. The base stand of claim 1, further comprising a first insert inserted into said first opening of said main body and a second insert inserted into said second opening of said main body.

15. The base stand of claim 14, wherein said first insert and said second insert are both substantially rectangular in configuration.

16. The base stand of claim 15, wherein a portion of said first insert and a portion of said second insert protrudes outwardly from said first and second openings of said main body, respectively.

17. The base stand of claim 1, further comprising an insert comprising a front wall having a slot therein and a pair of side walls extending from said front wall, wherein said insert is inserted into one of said first and second openings of said main body third side wall.

18. A base stand and metal storage bin assembly comprising:

a metal storage bin having a top wall, a bottom wall and first and second opposed side walls;

a base stand for transporting said metal storage bin comprising:

a top wall, first side wall, a second side wall, a third side wall and a fourth side wall;

a first bracket mounted to said first side wall wherein said bracket extends below a bottom surface of said base stand to form a first leg of said base stand;

a second bracket mounted to said second side wall wherein said second bracket extends below said bottom surface of said base stand to form a second leg of said base stand;

wherein said third side wall comprises a first opening and a second opening for receiving associated forks of an associated forklift, and wherein said metal storage bin is positioned on said top wall of said base stand such that said first and second brackets extend along a portion of said first and second side walls of said metal storage bin for providing lateral support to said bin first and second walls.

19. The base stand of claim 18, wherein said first bracket comprises a first wall which extends above said top wall of said base stand when said first bracket is mounted to said base stand.

20. The base stand of claim 19, wherein said second bracket comprises a first wall which extends above said top wall of said base stand when said second bracket is mounted to said base stand.

21. The base stand and metal storage bin assembly of claim 18, further comprising:

a second metal storage bin having a top wall, a bottom wall and first and second opposed side walls;

a second base stand for transporting said second metal storage bin comprising:

a top wall, first side wall, a second side wall, a third side wall and a fourth side wall;

a third bracket mounted to said first side wall of said second base stand;

a fourth bracket mounted to said second side wall of said second base stand;

wherein said third side wall of said second base stand comprises a first opening and a second opening for receiving associated forks of an associated forklift, and wherein said second metal storage bin is positioned on said top wall of said second base stand such that said third and fourth brackets extend along a portion of said first and second side walls of said second metal storage bin for providing lateral support to said second metal bin first and second walls; and wherein said third and fourth brackets are seated on a top surface of said first metal bin in a stacked configuration.

* * * * *